US012565693B2

(12) United States Patent
Morris et al.

(10) Patent No.: US 12,565,693 B2
(45) Date of Patent: Mar. 3, 2026

(54) METHOD FOR RECOVERING PRECIOUS METALS FROM THIOSULFATE LEACH SOLUTIONS

(71) Applicant: Barrick Mining Corporation, Toronto (CA)

(72) Inventors: Allen Robert Morris, Elko, NV (US); Tyler Warnock Carroll, Elko, NV (US)

(73) Assignee: Barrick Mining Corporation, Toronto (CA)

( * ) Notice: Subject to any disclaimer, the term of this patent is extended or adjusted under 35 U.S.C. 154(b) by 931 days.

(21) Appl. No.: 16/892,043

(22) Filed: Jun. 3, 2020

(65) Prior Publication Data

US 2020/0377970 A1 Dec. 3, 2020

Related U.S. Application Data

(60) Provisional application No. 62/856,545, filed on Jun. 3, 2019.

(51) Int. Cl.
*C22B 11/00* (2006.01)
*C22B 3/16* (2006.01)

(52) U.S. Cl.
CPC ..... *C22B 11/04* (2013.01); *C22B 3/16* (2013.01)

(58) Field of Classification Search
CPC .... C22B 3/04; C22B 3/06; C22B 3/08; C22B 3/16; C22B 3/20; C22B 3/205;
(Continued)

(56) References Cited

U.S. PATENT DOCUMENTS 4,070,182 A 1/1978 Genik-Sas-Berezowsky et al.
4,269,622 A 5/1981 Kerley, Jr.
(Continued)

FOREIGN PATENT DOCUMENTS

CL 201401615 11/2014
CN 108546827 9/2018
(Continued)

OTHER PUBLICATIONS

Dong, et al., "Recovery of Gold from Pregnant Thiosulfate Solutions by the Resin Adsorption Technique," Metals, 2017, vol. 7(12), 555, pp. 1-17.
(Continued)

*Primary Examiner* — Vanessa T. Luk
(74) *Attorney, Agent, or Firm* — Sheridan Ross P.C.

(57) ABSTRACT

The present disclosure is directed to a process for thiosulfate leaching of a precious metal-containing material and recovering a precious metal from a pregnant leach solution using a resin extractant. The precious metal is eluted from the loaded resin optionally using an eluant comprising trithionate. Various process improvements include maintaining the thiosulfate-containing leach solution substantially free of thiols and amines, maintaining a concentration of a sulfide in the thiosulfate leach solution of no more than about 100 ppm, recycling the barren resin free of contact with a sulfide, bisulfide, and polysulfide, and/or maintaining a concentration of tetrathionates, trithionates, sulfur-oxygen anions, and/or combinations thereof within about 50% of a concentration level of the one or more of tetrathionates, trithionates, sulfur-oxygen anions, the combinations thereof in the precious metal-containing solution before contact with the recycled barren resin.

29 Claims, 8 Drawing Sheets

(58) Field of Classification Search
CPC .... C22B 3/22; C22B 3/24; C22B 3/42; C22B 3/44; C22B 3/46; C22B 11/00; C22B 11/04; C22B 11/042; C22B 11/044; C22B 11/046; C22B 11/048
See application file for complete search history.

(56) References Cited

U.S. PATENT DOCUMENTS

| | | | | |
|---|---|---|---|---|
| 4,369,061 | A | 1/1983 | Kerley, Jr. | |
| 4,654,078 | A | 3/1987 | Perez et al. | |
| 5,536,297 | A | 7/1996 | Marchbank et al. | |
| 5,785,736 | A | 7/1998 | Thomas et al. | |
| 6,344,068 | B1 † | 2/2002 | Fleming | |
| 9,051,625 | B2 | 6/2015 | Choi et al. | |
| 2002/0092377 | A1 * | 7/2002 | Ji | C22B 3/08 75/631 |
| 2003/0051581 | A1 | 3/2003 | Zhang et al. | |
| 2011/0011216 | A1 | 1/2011 | Jeffrey | |
| 2012/0183433 | A1 * | 7/2012 | Choi | C22B 3/12 420/501 |
| 2013/0091990 | A1 * | 4/2013 | Choi | C22B 11/04 423/24 |

FOREIGN PATENT DOCUMENTS

| | | | |
|---|---|---|---|
| CN | 108546827 | A1 † | 9/2018 |
| CN | 108546828 | | 9/2018 |
| WO | WO 01/23626 | | 4/2001 |
| WO | 01/88212 | A2 † | 11/2001 |
| WO | WO 01/88212 | | 11/2001 |
| WO | WO 2004/106562 | | 12/2004 |
| WO | WO 2007/098603 | | 9/2007 |
| WO | WO 2007/137325 | | 12/2007 |
| WO | WO 2012/071342 | | 5/2012 |
| WO | WO 2012/076981 | | 6/2012 |
| WO | WO 2012/174349 | | 12/2012 |
| WO | WO 2020/245652 | | 12/2020 |

OTHER PUBLICATIONS

Fleming et al., "Recent advances in the development of an alternative to the cyanidation process: Thiosulfate leaching and resin in pulp," Mining & Metallurgy Processing, 2003, vol. 20(1), pp. 1-9.
International Search Report and Written Opinion for International (PCT) Patent Application No. PCT/IB2020/000430, dated Sep. 29, 2020 17 pages.
Official Action for Canadian Patent Application No. 3,141,559, dated Sep. 27, 2022 5 pages.
Jeffrey et al., "Ion exchange adsorption and elution for recovering gold thiosulfate from leach solutions," Hydrometallurgy, 2010, vol. 100, pp. 136-143.
Third Party Observation for International (PCT) Patent Application No. PCT/IB2020/000430, dated Jul. 22, 2021 34 pages.
International Report on Patentability for International (PCT) Patent Application No. PCT/IB2020/000430, dated Dec. 16, 2021 10 pages.
Official Action for Australian Patent Application No. 2020288876, dated Nov. 17, 2022 4 pages.
M.I. Jeffrey, Ion Exchange adsorption and elution for recovering gold thiosulfate from leach solutions, Hydrometallurgy 100 (2010) 136-143, published 2009.†
Z. Dong et al., Recovery of Gold from Pregnant Thiosulfate Solutions by the Resin Absorption Technique, Metals 2017, 7, 555, published 2017.†

* cited by examiner
† cited by third party

METHOD FOR RECOVERING PRECIOUS METALS FROM THIOSULFATE LEACH SOLUTIONS

CROSS REFERENCE TO RELATED APPLICATION

The present application claims the benefits of U.S. Provisional Application No. 62/856,545, filed Jun. 3, 2019, entitled "METHOD AND SYSTEM FOR RECOVERING GOLD FROM REFRACTORY MATERIALS", which is incorporated herein by this reference in its entirety.

FIELD

This disclosure relates generally to the recovery of metals by hydrometallurgical process and specifically to the recovery of metals by processes employing ion exchange adsorption and elution steps.

BACKGROUND

Gold is typically recovered from ores using a conventional cyanidation leach process. In the process, gold reacts with cyanide and oxygen by the following reaction:

$$4Au+O_2+8CN^-+2H_2O \rightarrow 4Au(CN)_2^-+4OH^- \quad (1)$$

Gold is usually then recovered from solution using activated carbon as an adsorbent. Ion exchange resins may also be used to adsorb the gold cyanide complex, followed by elution with an acidic thiourea mixture. Thiosulfate leaching is a potential environmentally acceptable alternative to cyanidation and, in this process, the gold is leached as the gold thiosulfate complex. However, this complex is not readily adsorbed by activated carbon and so anion exchange resins may be preferred. Other metals, such as copper and mercury, also adsorb onto resins concurrently with gold.

The thiosulfate leach process has been demonstrated to be technically viable for a range of different ore types. For instance, Berezowsky et al., U.S. Pat. No. 4,070,182, disclose a process to leach gold from copper-bearing sulfidic material with ammonium thiosulfate. Kerley Jr., U.S. Pat. Nos. 4,269,622 and 4,369,061, disclose using an ammonium thiosulfate leach solution containing copper to leach gold and silver from ores containing manganese. Perez et al., U.S. Pat. No. 4,654,078, disclose leaching gold and silver with a copper-ammonium thiosulfate lixiviant to produce a pregnant leach solution, from which gold and silver are recovered by copper cementation. In these processes, ammonium thiosulfate is the preferred lixiviant, which results in the production of a tailings product which contains ammonia/ammonium ions. This is of concern from an environmental perspective. A leach process incorporating non-ammonium sources of thiosulfate, including sodium thiosulfate and calcium thiosulfate is therefore preferred.

Following leaching, gold may be loaded onto resins from either a slurry or a solution, and the gold is subsequently recovered from the resin by elution or desorption. Gold can be eluted from resins using eluants, such as thiocyanate, polythionate or nitrate based eluants. However, relatively concentrated solutions are required for the elution process. For example, in a nitrate elution process, 2M ammonium nitrate is preferred as disclosed in PCT Application No. WO 01/23626. This is a relatively high concentration of nitrate that creates demonstrable cost implications for the elution step and environmental impacts in disposing of spent ammonium nitrate solutions.

Thiocyanate solutions are known to rapidly elute gold (either cyanide or thiosulfate complexes) from resins. However, the resin must be regenerated prior to addition back into the resin-in-pulp circuit; otherwise, the thiocyanate will accumulate in process water, eventually leading to environmental problems and reduced gold loading. In addition, the loss of thiocyanate may be economically unacceptable. Regeneration in the thiocyanate system is also complicated as thiocyanate is removed using ferric sulfate followed by regeneration of thiocyanate by addition of sodium hydroxide. The rapid change in pH in the elution and regeneration steps produces osmotic shock in the resin and this leads to resin loss through breakage. A number of chemical reagents are also required at a plant site that may be remote. It is therefore desirable, subject to plant operational efficiency, to reduce the inventory of different chemicals used in plant operation. An aim is to use fewer reagents in lesser quantity.

A polythionate eluant system utilizes a mixture of trithionate and tetrathionate. Since these species are strongly adsorbed on a resin, they can be used to effectively elute gold. The high affinity of polythionates for the resin necessitates a regeneration step. Regeneration is accomplished by treating the resin with sulfide, bisulfide, or polysulfide ions to convert the polythionates to thiosulfate. A problem with polythionate elution is the stability of the tetrathionate solution. In the presence of thiosulfate, tetrathionate undergoes a decomposition reaction to form trithionate and elemental sulfur, and in the presence of silver or copper, decomposes to precipitate copper or silver sulfides. Trithionate decomposes to form sulfate, especially when present in high concentrations. Such decomposition reactions result in losses that add to the cost of the process.

In United States Patent Application 2011/0011216, it is shown that the addition of sulfite ions to various eluants enables the elution to be conducted with lower concentrations of reagents. A mixed trithionate/sulfite system is shown to be especially effective at eluting gold from the resin.

SUMMARY

The present disclosure provides various processes for recovering metals from ion exchange resins.

In an embodiment of the disclosure, a process includes the steps of:

(a) leaching a precious metal-containing material with a thiosulfate-containing leach solution to form a precious metal-containing solution, wherein the thiosulfate-containing leach solution is substantially free of thiols and amines;

(b) loading a precious metal dissolved in the precious metal-containing solution onto a barren resin to form a precious metal-loaded resin and a precious metal barren solution;

(c) contacting the precious metal-loaded resin with a precious metal-barren eluant to form a precious metal-rich eluant and the barren resin; and (d) recovering the precious metal from the precious metal eluant.

In an embodiment, a process includes the steps of:

(a) contacting a precious metal-containing thiosulfate leach solution with a barren ion exchange resin to form a precious metal-loaded resin and a precious metal barren thiosulfate leach solution, wherein a concentration of a sulfide in the precious metal-containing thiosulfate leach solution is no more than about 100 ppm;

(b) contacting the precious metal-loaded resin with a precious metal-barren eluant to form a precious metal-rich eluant and a barren resin; and (c) recovering the precious metal from the precious metal-rich eluant to form the precious metal-barren eluant for recycle to step (b).

In an embodiment, a process includes the steps of:

(a) leaching a precious metal-containing material with a thiosulfate-containing leach solution to form a precious metal-containing solution;

(b) loading a precious metal dissolved in the precious metal-containing solution onto a barren resin to form a precious metal-loaded resin and a precious metal barren solution, wherein the precious metal-containing solution further comprises copper and wherein copper is loaded with the precious metal onto the precious metal-loaded resin;

(c) contacting the precious metal-loaded resin with a precious metal eluant to form a precious metal-rich eluant and the barren resin, wherein, immediately before the contacting step, at least about 5 mole % of the Group 11 (IUPAC) metals loaded onto the precious metal-loaded resin comprises copper and more than about 50 mole % of the Group 11 metals loaded onto the resin comprise gold; and (d) recovering the precious metal from the precious metal eluant.

In an embodiment, a process includes the steps of:

(a) leaching a precious metal-containing material with a thiosulfate-containing leach solution to form a precious metal-containing solution, wherein the thiosulfate-containing leach solution is substantially free of thiols and amines;

(b) loading a precious metal dissolved in the precious metal-containing solution onto a barren resin to form a precious metal-loaded resin and a precious metal barren solution;

(c) contacting the precious metal-loaded resin with a precious metal eluant to form a precious metal-rich eluant and the barren resin; and (d) recovering the precious metal from the precious metal eluant, wherein the barren resin is recycled to the loading step and wherein a concentration of one or more of tetrathionates, trithionates, and/or sulfur-oxygen anions in the precious metal-containing leach solution after contact with the recycled barren resin is maintained within about 50% of a concentration level of the one or more of tetrathionates, trithionates, and/or sulfur-oxygen anions in the precious metal-containing solution before contact with the recycled barren resin.

The precious metal-containing feed material can comprise at least about 0.5 wt. % preg-robbing carbonaceous materials and no more than about 0.35 oz/ton gold.

The precious metal-barren eluant can include a trithionate.

The elution of the gold from the resin can be free of prior elution of copper from the resin surface.

The precious metal-barren eluant can include sulfite ion, which can be present in a concentration of at least about 0.01 M. A pH of the precious metal-barren eluant can be maintained within a range of from about pH 4.5 to about pH 14. A trithionate concentration in the precious metal-barren eluant can be at least about 0.01 M.

The precious metal-containing thiosulfate can be free or substantially free of liquid or solid recycled from tails generated in step (a).

The method can be free of gypsum precipitation from the tails.

The barren resin can be recycled to the loading step free of contact with a sulfide, bisulfide, and polysulfide (or sulfide anion) and can comprise at least about 0.1 mole/L of tetrathionate.

A concentration of thiosulfide in the precious metal-containing thiosulfate leach solution can be no more than about 10,000 ppm. The precious metal-containing thiosulfate leach solution can be substantially free of added copper.

For a selected volume of barren resin, a number of loading and elution cycles within a 24-hour period can be from about 1 to about 5.

While the process is described with respect to leaching, the process may also be applied to ion exchange for metal recovery following other hydrometallurgical processes.

The present disclosure can provide a number of advantages depending on the particular configuration. The process is particularly applicable to the elution of gold (and other precious metals). It may be applied as an adjunct to any leach or other hydrometallurgical process for the extraction of such metals, including resin-in-pulp processes or other ion exchange unit operations and/or lixiviants other than or in addition to thiosulfate. The process may be particularly advantageously applied to leached metal recovery following a thiosulfate leach process. The process for recovery of metals by ion exchange can give high elution efficiency but does not generate waste solutions or resins, which contain undesirable species that either cause issues with their disposal or recycle back to the process.

These and other advantages will be apparent from the disclosure of the aspects, embodiments, and configurations contained herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

The terms "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

"Adsorption" is the adhesion of atoms, ions, biomolecules, or molecules of gas, liquid, or dissolved solids to a surface. The exact nature of the bonding depends on the details of the species involved, but the adsorption process is generally classified as physisorption (characteristic of weak van der Waals forces) or chemisorption (characteristic of covalent bonding). It may also occur due to electrostatic attraction.

"Ion exchange resin" refers to a resin that is able, under selected operating conditions, to exchange ions between two electrolytes or between an electrolyte solution and a complex.

A "peroxide" refers to a compound containing an oxygen-oxygen single bond or the peroxide anion $[O—O]^{2-}$. The O—O group is called the peroxide group or peroxo group.

"Sorb" means to take up a liquid or a gas either by sorption.

"Desorption" is the reverse of adsorption.

The term "means" as used herein shall be given its broadest possible interpretation in accordance with 35 U.S.C., Section 112(f) and/or Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the disclosure, brief description of the drawings, detailed description, abstract, and claims themselves.

Unless otherwise noted, all component or composition levels are in reference to the active portion of that component or composition and are exclusive of impurities, for example, residual solvents or by-products, which may be present in commercially available sources of such components or compositions.

All percentages and ratios are calculated by total composition weight, unless indicated otherwise.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein. By way of example, the phrase from about 2 to about 4 includes the whole number and/or integer ranges from about 2 to about 3, from about 3 to about 4 and each possible range based on real (e.g., irrational and/or rational) numbers, such as from about 2.1 to about 4.9, from about 2.1 to about 3.4, and so on.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

The present disclosure is directed to thiosulfate leaching of precious metal-containing materials. The materials can be any refractory or double refractory preg-robbing precious metal-containing material. The precious metal-containing material includes ore, concentrates, tailings, recycled industrial matter, spoil, or waste and mixtures thereof. The process of this disclosure is particularly effective for recovering precious metals, particularly gold, from refractory carbonaceous material. The refractory or double refractory alkaline or acidic (e.g., sulfidic) precious metal (e.g., gold and/or silver)-containing material is typically subjected to pressure oxidation, such as in an autoclave, to form an oxidized output slurry, that includes a precious metal-containing residue. Thiosulfate has also been shown to be effective in recovering precious metals from such pretreated refractory preg-robbing carbonaceous ores and sulfidic ores. As used herein, "preg-robbing" is any material that interacts with (e.g., adsorbs or binds) precious metals after dissolution by a lixiviant, thereby interfering with precious metal extraction, and "carbonaceous material" is any material that includes one or more carbon-containing compounds, such as humic acid, graphite, bitumens and asphaltic compounds. The precious metal(s) can be associated with nonprecious metals, such as base metals, e.g., copper, nickel, and cobalt.

In one application, the feed includes at least about 0.5 wt. %, more typically at least about 1 wt. %, and more typically at least about 1.5 wt. % but typically no more than about 7.5 wt. % and more typically no more than about 5 wt. % total carbonaceous material.

In one application, the gold content of the feed is at least about 0.01 oz/ton gold and more typically at least about 0.05 oz/ton.

Figure 1:
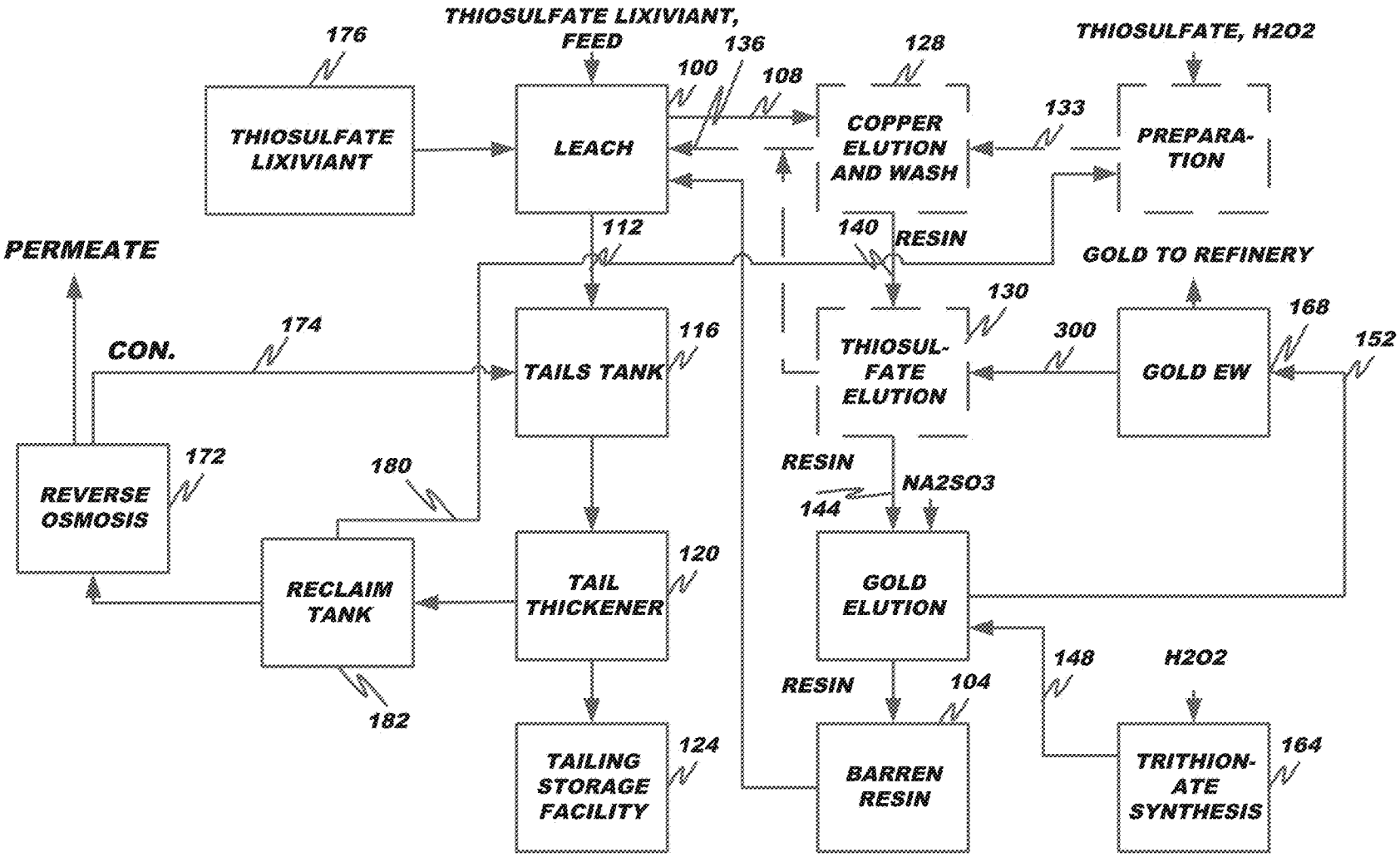
FIG. 1 is a schematic diagram of a thiosulfate resin-in-pulp process.

In a preferred embodiment of the disclosure, gold and other precious and metals in a feed are recovered into solution at a metal recovery plant by a thiosulfate leaching process 100 followed by ion exchange to recover gold thiosulfate complex present in pregnant leach liquor, or precious metal-containing solution, from the leach step via a resin-in-pulp (RIP) or resin-in-leach (RIL) process, as shown schematically in FIG. 1. Leaching 100 is normally performed by heap or tank leaching techniques. The tails 112 are sent to a tails tank 116, then optionally to a tail thickener 120, and then to a tailing storage facility 124.

In one leach circuit configuration, the gold-containing solution in the leach step 100 includes thiosulfate as a leaching agent. The thiosulfate concentration in the solution commonly ranges from about 0.005 to about 5 M, more commonly from about 0.01 to about 2.5 M, and more commonly from about 0.02 to about 2 M. In some applications, it has been discovered that relatively low thiosulfate concentration levels can be employed in the lixiviant without compromising gold recovery. The thiosulfate concentration in the lixiviant commonly is no more than about 10,000 ppm, more commonly no more than about 8,500 ppm, more commonly no more than about 7,500 ppm, more commonly less than about 5,000 ppm, more commonly no more than about 3,500 ppm, and even more commonly no more than about 2,500 ppm.

As will be appreciated, in thiosulfate-based gold leaching systems copper is believed to catalytically oxidize gold. In many applications, the gold-containing solution in the leach step 100 is maintained at a leach copper solution concentration in the range of from about 0.1 to about 100 ppm, more commonly in the range of about 0.1 to about 50 ppm, more commonly in the range of about 0.1 to about 25 ppm, more commonly in the range of about 0.1 to about 15 ppm, and more commonly in the range of about 0.1 to about 5 ppm. In some applications, it has been discovered that copper does not need to be added in the leach step 100 and therefore that the leach step 100 can be substantially, or completely, free of added copper. The copper present in the feed is typically at a high enough level to enable high gold recovery while maintaining thiosulfate conversion to polythionates to acceptable levels.

In many applications, the gold-containing solution, or lixiviant, in the leach step 100 is maintained at a leach copper solution concentration commonly of no more than about 100 ppm, more commonly of no more than about 75 ppm, more commonly of no more than about 50 ppm, and more commonly no more than about 25 ppm and commonly at least about 0.1 ppm and more commonly at least about 5 ppm and has a gold solution concentration commonly of no more than about 0.010 ounces/tonne ("opt"), more commonly of no more than about 0.0075 opt, more commonly of no more than about 0.0050 opt, more commonly of no more than about 0.0025 opt, and more commonly of no more than about 0.001 opt.

In the ion exchange step (which is typically performed in the leach step 100), a strong base anion exchange resin 104 is used to adsorb the gold thiosulfate complex from the gold-containing solution to form a gold-loaded resin 108. There are a number of commercially available strong base ion exchange resins which have an affinity to gold and which are useful for the ion exchange process. The functional group of most strong base resins is quaternary ammonium, R4N+. Such a resin may be in sulfate or chloride form. Any other anion exchange resin may, however, be used. The typical capacity of the strong base resins is from about 1 to about 1.3 eq/L, and, for the purposes of demonstrating some aspects of the process, the discussion below is based on a resin having a capacity of about 1.2 eq/L. A typical concentration of resin ranges from about 5 to about 250 ml/L, more typically from about 10 to about 150 ml/L, and more typically from about 15 to about 100 ml/L, and even more typically from about 15 to about 75 ml/L. As will be appreciated, such resins can load not only gold but also copper from the pregnant leach liquor. Typically, at least about 2.5 mole %, more typically at least about 5 mole %, more typically at least about 10 mole %, and even more from about 15 to about 45 mole % of the Group IB (CAS) (or Group 11 (IUPAC)) metals of the Periodic Table of the Elements loaded onto the loaded resin is copper, with the remainder being primarily gold, though a small amount can be silver.

Following loading or adsorption of the thiosulfate complex onto the resin 104, the gold is recovered from the loaded resin 108 by elution; that is, desorption. A simplified elution flowsheet is shown in FIG. 1. In this flowsheet, any washing or draining stages have been omitted for simplicity, as they do not materially change the nature of the elution system.

The optional first stage is copper pre-elution (step 128 of FIG. 1), which is conducted using a copper eluant solution 133 containing thiosulfate and, optionally, trithionate to precondition the resin 140 (FIG. 1) for precious metal elution. The main purpose of this stage is to strip the copper from the resin before thiosulfate elution 130, and hence reduce the quantity of copper that reports to the gold product. Surprisingly and unexpectedly, copper pre-elution is optional in many applications and not required to obtain acceptable levels of gold recovery. In other process configurations, it may be performed to avoid complications posed by the presence of copper in the recovered gold product.

When copper elution is performed, the thiosulfate in the copper eluant solution can be any source of thiosulfate, such as an alkali metal thiosulfate (e.g., sodium or potassium thiosulfate), an alkaline earth metal thiosulfate (e.g., calcium thiosulfate), or ammonium thiosulfate. The latter is not preferred, unless the leaching circuit also utilizes ammonium thiosulfate. The thiosulfate concentration in the pre-elution copper eluant and product 15 typically ranges from about 30 to about 200 g/L, and the desorbed copper concentration in the copper-rich eluant ranges from about 100 to about 1,500 ppm.

When present, the concentration of trithionate in the copper eluant solution 133 typically ranges from about 0.01 to about 0.1 M. The trithionate may be generated by contacting an oxidant, commonly a peroxide, with the copper eluant solution 133, which converts thiosulfate into trithionate per equation (2) below. The copper pre-elution product 136 can be used as a thiosulfate feed stream for leaching, and hence can be recycled. In one process configuration, the barren electrowinning solution 300 is contacted with the resin 140 to elute thiosulfate 130, which can then be recycled to the leach step 100.

As noted, in some process configurations copper pre-elution is not performed. It has been discovered that copper collected on the surface of the gold-rich resin does not need to be removed in a copper elution step 128 prior to gold elution. In other words, the copper can be present on the gold-rich resin surface at levels in excess of those following the copper elution step 128. In such applications, typically, at least about 2.5 mole %, more typically at least about 5 mole %, more typically at least about 10 mole %, and even more from about 15 to about 45 mole % of the Group IB (CAS) (or Group 11 (IUPAC)) metals of the Periodic Table of the Elements loaded onto the loaded resin is copper, with the remainder (typically more than about 50 mole % and more typically at least about 60 mole %) being gold, though a small amount (e.g., typically less than about 25 mole %) can be silver.

Precious metal elution is then conducted from the resin 144 using a mixture of trithionate and sulfite ion as an eluant 148. Commonly, a concentration of trithionate in the precious metal eluant 148 is at least about 0.01 M, more commonly is at least about 0.05 M, more commonly ranges from about 0.1 to about 5 M, and even more commonly ranges from about 0.2 to about 2 M. The concentration of sulfite ion in the precious metal eluant 148 commonly is at least about 0.01 M, more commonly is at least about 0.1 M, and even more commonly ranges from about 0.1 to about 2 M. The concentration of dissolved gold in the gold-rich eluant 152 typically ranges from about 100 to about 500 ppm. The pH of the precious metal eluant 148 is typically maintained within a range of from about pH 4.5 to about pH 14.

This elution mixture is generated by mixing peroxide in a trithionate reactor with the sodium thiosulfate, as per reaction 2.

$$2Na_2S_2O_3+4H_2O_2 \rightarrow Na_2S_3O_6+Na_2SO_4+4H_2O \quad (2)$$

This reaction also generates heat, and therefore the preferred embodiment of the flowsheet utilizes either a cooled or chilled reactor to remove heat. The reaction temperature is preferably in the range of about 10° C. to about 60° C. At higher reaction temperatures, some loss of trithionate becomes evident. The addition of peroxide is commonly between about 75% and about 110%, and more commonly between about 75% and about 97%, of the stoichiometric amount to react with the thiosulfate contained in the spent regeneration solution 156 (reaction 2).

One method of generating additional trithionate is to add extra thiosulfate to the trithionate synthesis stage. When running an ammonium thiosulfate-based leach system, the addition of ammonium thiosulfate to trithionate synthesis is ideal. However, if the generation of ammonium sulfate in the process is not desired, another approach is required. Sodium thiosulfate can be used, but it is an expensive reagent. Alternatively, sodium thiosulfate can be generated from the cheaper calcium thiosulfate feed material by precipitation of calcium. The precipitation of calcium can be conducted using a source of either sodium sulfate and/or sodium carbonate.

After elution, the resin 104 is almost completely loaded with trithionate, Based on the prior art, a skilled artisan would understand trithionate to reduce the equilibrium gold loading in the adsorption circuit, and therefore recycle of a resin without the regeneration (and hence fully loaded with trithionate) would be problematic. Surprisingly and unexpectedly, it has been discovered that resin regeneration can be omitted without compromising gold recovery so that the trithionate-loaded resin can be returned to the leach step 100. The chemical equilibria in the leach and gold elution steps enables the resin to load gold in preference to trithionate in the leach step 100 and (unload gold and) load trithionate in preference to gold in the gold elution step. While the leaching and gold eluting steps commonly have similar pH levels, the equilibria are understood to be driven by concentration of trithionate. At higher trithionate levels (e.g., at least about 25,000 ppm and more commonly at least about 50,000 ppm trithionate) in the gold elution step, the resin loads trithionate in preference to dissolved gold and at the lower trithionate levels (no more than about 5,000 ppm, more commonly no more than about 2,500 ppm, more commonly no more than about 1,000 ppm, and more commonly no more than about 500 ppm trithionate) in the leaching step 100, the resin loads dissolved gold in preference to trithionate.

The amount of trithionate loaded onto the barren resin can vary depending on the application. For a resin capacity of 1.2 eq/L, the maximum loading of trithionate, which is a 2-charge, is 0.6 mole/L of resin. The resin, is typically, close to being saturated with trithionate after elution, a condition which is commonly required to ensure optimal gold elution; that is, a loading of 0.6 moles of trithionate per L of resin is required in such applications. In most applications, the barren resin, after elution, comprises typically at least about 0.1 mole/L of trithionate, more typically at least about 0.25 mole/L of trithionate, and even more typically from about 0.3 to about 0.6 mole/L of trithionate.

While not wishing to be bound by any theory, it is believed that gold recovery in the leach step 100 is decreased by sulfide ion carried by resin beads 104 that are recirculated to the leach step 100. The recirculated sulfide ion can cause dissolved gold to precipitate as gold sulfide during the leach step 100, thereby preventing it from loading onto the resin surface. To avoid this detrimental outcome, the recirculated resin 104 and thiosulfate lixiviant in the leach step 100 commonly have no more than about 100 ppm, more commonly no more than about 75 ppm, more commonly no more than about 50 ppm, more commonly no more than about 25 ppm, more commonly no more than about 10 ppm, more commonly no more than about 5 ppm, more commonly no more than about 1 ppm, more commonly no more than about 25 ppb, more commonly no more than about 10 ppb, more commonly no more than about 5 ppb, more commonly no more than about 1 ppb, and even more commonly is free of sulfide ion.

It has further been discovered that the number of elution and regeneration cycles completed is often related inversely to gold recovery and that the gold recovery is inversely proportional to the gold content of the feed. While not wishing to be bound by any theory, these effects result from the need to reduce as much as possible the frequency of resin bead recycle to the leach step 100 from the gold elution step. This is so because it is believed that maintaining optimal gold recovery requires the maintenance of a constant thermodynamic state or environment in the leach step 100. Recycling resin beads to the leach step 100 can disrupt, or change, the thermodynamic state, thereby decreasing gold recovery due to the presence in the leach step of deleterious chemical species that are absorbed by strong-base resins (such as tetrathionate, trithionate, sulfur-oxygen anions, and metal (e.g., lead, copper, and zinc) thiosulfate complexes) generated in or otherwise recirculated from the gold elution step. These species can compete with gold for absorption sites on the resin. The number of elution cycles within a 24-hour period typically ranges from about 1 to 5, with the fewer elution cycles being preferred. This can maintain the levels of the deleterious chemical species at levels low enough that they do not compete strongly with gold for absorption sites on the resin. Stated differently, the concentration levels of each of the deleterious chemical species in the leach step 100 are typically maintained within about 50%, more typically within about 25%, more typically within about 20%, more typically within about 15%, more typically within about 10%, and even more typically within about 5% of the concentration level present before contact of the recycled resin with the leach solution. Maintaining a substantially constant thermodynamic state in the leach step can enable the process to a lower residence time of the feed in the leach step without compromising gold recovery.

Typically, the residence time of the feed in the leach step is no more than about 15 hours and more typically no more than about 10 hours.

Figure 3:
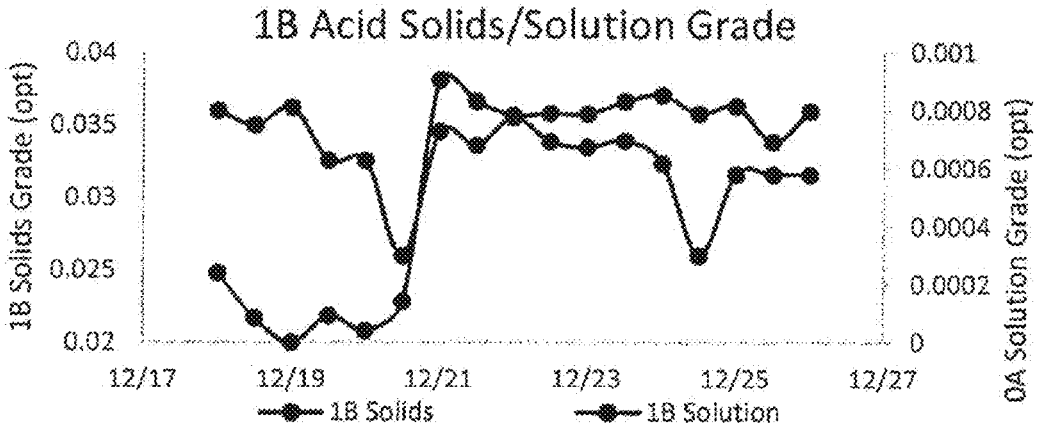
FIG. 3 plots solids grade (opt) (vertical axis) against date (horizontal axis) for an experiment using 1B acid solids.

The gold can be recovered from the trithionate product solution 152 by a number of technologies, including but not limited to, electrowinning 168, cementation by metals such as copper and zinc, and precipitation by sulfide-containing solutions. Each one of these technologies has been demonstrated to successfully recover the gold to very low concentrations (>99% removal of gold). In the preferred embodiment, standard gold electrowinning cells 168 are adopted, and the integrated elution/electrowinning flowsheet is shown in FIG. 3. The barren electrowinning solution 300 can be recycled back to the trithionate synthesis step 164 and/or after optional copper preelution. By adding the barren electrowinning solution 300 to the trithionate synthesis, some additional thiosulfate that is stripped off the resin during gold elution is recycled. Alternatively, when adding the barren electrowinning solution 300 as a step after pre-elution, the sulfite present in this stream reacts with any adsorbed tetrathionate on the resin, which is an effective conditioning step to ensure optimum gold elution performance. The same benefit is achieved when recycling the barren electrowinning solution either before the copper pre-elution, or by mixing the barren electrowinning with the copper pre-eluant. For all these options, trithionate is recycled back to the elution system, and to maintain the water balance, there is an additional volume of copper pre-eluate, which mainly contains copper, sulfate and thiosulfate, since this product is taken before trithionate and gold break through, as discussed below.

A similar principle applies for the recovery of gold using cementation of precipitation, whereby the barren solution is recycled back to the elution system to recover trithionate.

As can be seen from FIG. 1, the supernatant of the tailings storage facility 124 is not recycled to the reclaim tank 182 (as shown in FIG. 1) as it has been surprisingly and unexpectedly discovered that treatment of the supernatant, such as by reverse osmosis 172, and/or reuse of the resulting permeate or liquid from the reclaim tank 182 can negatively impact gold recovery. Stated differently, the reclaim tank is at least substantially free (e.g., typically containing no more than about 10 vol. % and more typically containing no more than about 5 vol. % supernatant from the tailings storage facility 124, Additionally neither the permeate nor concentrate of reverse osmosis 172 is recirculated for use in generating the thiosulfate lixiviant 176. It has been discovered that recirculating one or both of these streams can reduce gold recovery in the leach step 100. While not wishing to be bound by any theory, it is believed that thiols and/or amines in the recycled stream(s) act as gold chelators or otherwise sequester dissolved gold, thereby preventing the dissolved gold from being collected by the resin beads (particularly when the resin beads comprise a quaternary ammonium). For this reason, the thiosulfate-containing stream 180 is typically substantially free e.g., typically containing no more than about 10 vol. % and even more typically no more than about 5 vol. %), or completely free, of liquid and/or dissolved solids from the reclaim tank 182.

To realize higher gold recoveries, the thiosulfate lixiviant 176 in the leach step 100 has commonly no more than about 100 ppm, more commonly no more than about 180 ppb, more commonly no more than about 100 ppb, more commonly no more than about 75 ppb, more commonly no more than about 50 ppb, more commonly no more than about 25 ppb, more commonly no more than about 10 ppb, more commonly no more than about 5 ppb, more commonly no more than about 1 ppb, and even more commonly is free of amines (e.g., a compound or functional group that contains a basic nitrogen atom with a lone pair; amines are typically derivates of ammonia in which one or hydrogen atoms have been replaced by a substituent such as an alkyl or aryl group) and/or thiols (e.g., an organic compound containing the group —SH, i.e. a sulfur-containing analog of an alcohol).

Because no liquid or solid component of the concentrate and optionally the permeate is recirculated to thiosulfate lixiviant generation or present in the leach step 100, there is no need to precipitate gypsum and gypsum precipitation is not performed. Stated differently, the thiosulfate lixiviant used in the leach step 100 is free of liquid and solid components of the concentrate 174.

EXPERIMENTAL

The following examples are provided to illustrate certain aspects, embodiments, and configurations of the disclosure and are not to be construed as limitations on the disclosure, as set forth in the appended claims. All parts and percentages are by weight unless otherwise specified.

Example 1

There has been a 10-20% gap between plant and lab recoveries based on the process of U.S. Pat. No. 9,051,625. To understand the cause(s) of the gap, multiple batch leach tests were conducted using resin-in-leach as taught by U.S. Pat. No. 9,051,625. Test parameters are outlined in the table below. Copper was added for all tests at a concentration of 20 ppm. Resin addition was approximately 30 $m^3$.

| Test # | Date | Tank | Ore | Dilution | Resin |
|---|---|---|---|---|---|
| 1 | 11/29-12/9 | 1B | Alk | Permeate | Barren/Fresh |
| 2 | 12/15-12/28 | 1B | Acid | TS Discharge | Barren |
| 3 | 12/16-12/29 | 0A | Acid | Permeate | Barren |

The daily solids and solution leach profile for each test are shown in the Figures. Across all three tests, leach kinetics seemed to be hindered and required upwards of a week before the solids profile leveled out. It should be noted that tank temperatures dropped at a rate of 5° F./day due to cooling of the tanks. Additionally, solution samples indicate the absence of copper in solution despite adding in sufficient copper to reach 20 ppm. In the 1B alkaline test, an additional 80 ppm of copper was added, however, copper was still not detected in solution.

Figure 2:
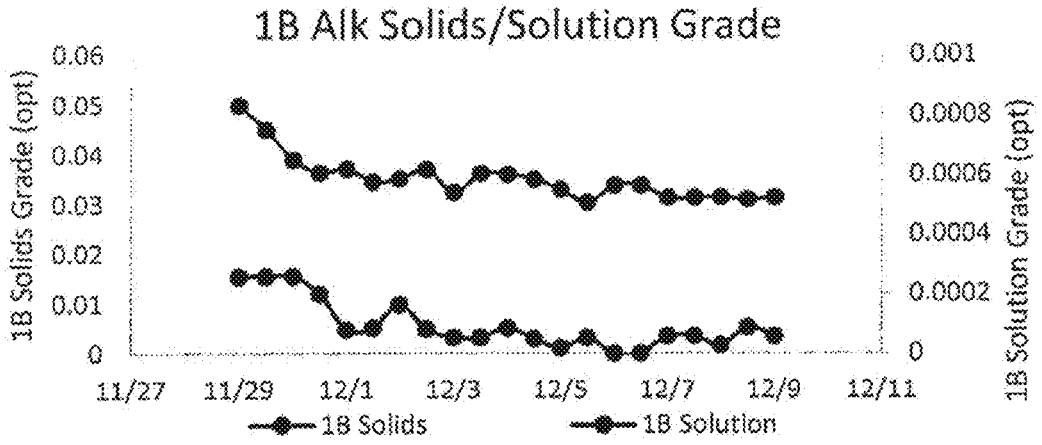
FIG. 2 plots solids grade (opt) (vertical axis) against date (horizontal axis) for an experiment using 1B alkaline solids.
Figure 4:
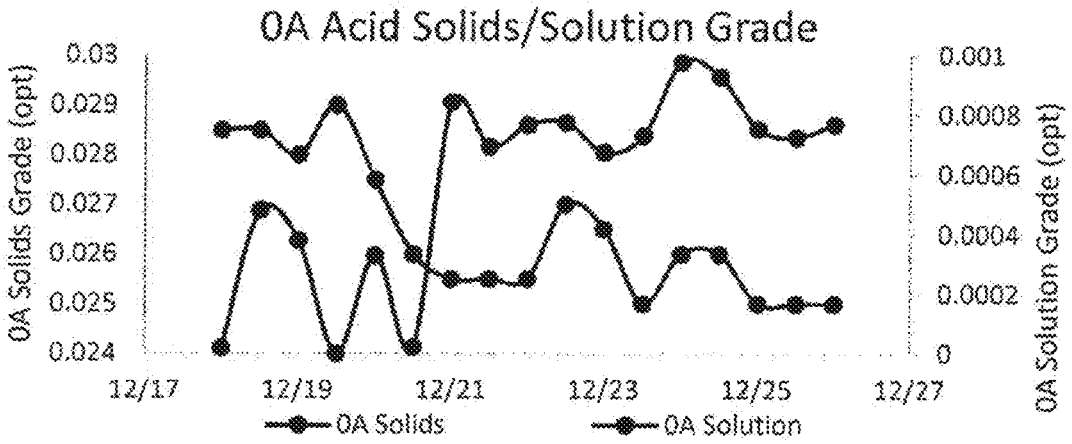
FIG. 4 plots solids grade (opt) (vertical axis) against date (horizontal axis) for an experiment using 0A acid solids.

The test results are shown in FIGS. 2-4. With reference to FIG. 2, soluble gold in the 1B alkaline test remained low (<0.002 opt) which may be explained by the utilization of a half barren and half fresh resin mix. With reference to FIGS. 3-4, solution gold in the other two tests remained low initially in the test, but climbed when the solids started to leach substantially. Solution gold remained at ~0.0008 opt until the end of the test which aligns HARIL data using barren resin.

Figure 5:
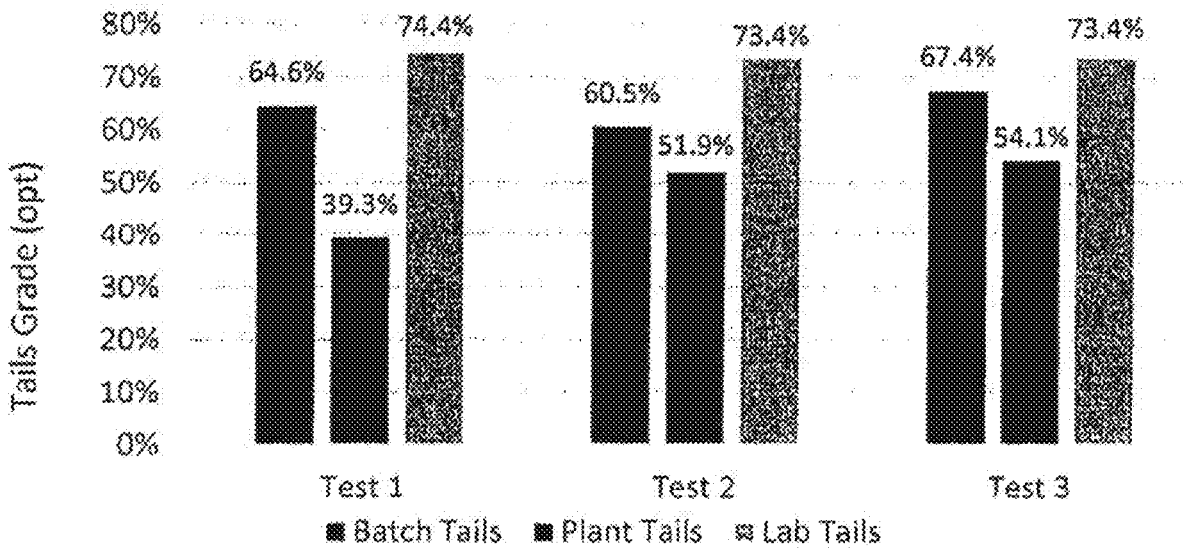
FIG. 5 is a bar graph of tails grade (opt) (vertical axis) against batch tails, plant tails, and lab tails (horizontal axis) comparing batch, plant and lab tails.

For consideration and with reference to FIG. 5, the batch leach recoveries were compared to the respective plant and lab recoveries as shown below. In all tests, the batch leach outperformed the plant significantly, however, a 5-10% recovery gap still exists compared to the lab. It should be noted that fresh resin was used in the lab test work. Nonetheless, the batch data bridges a large portion of the gap between plant and lab data.

Figure 6:
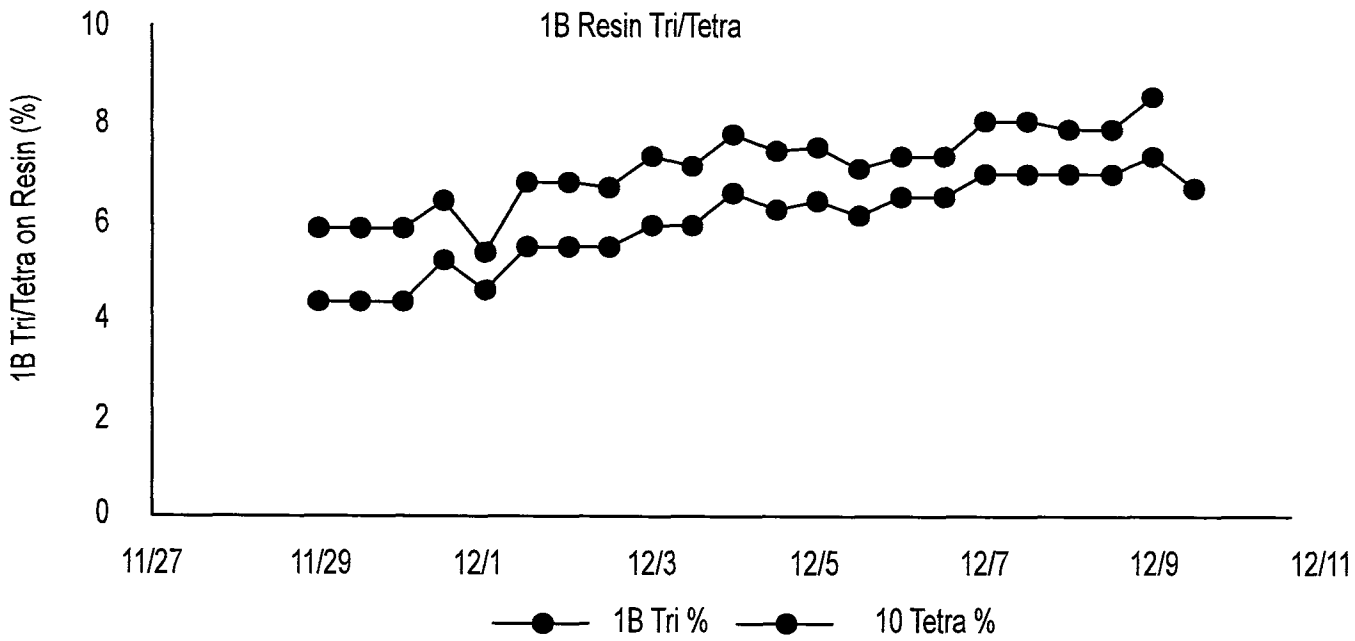
FIG. 6 tri/tetrathionates on resin (%) (vertical axis) against date (horizontal axis) for an experiment using 1B resin.
Figure 7:
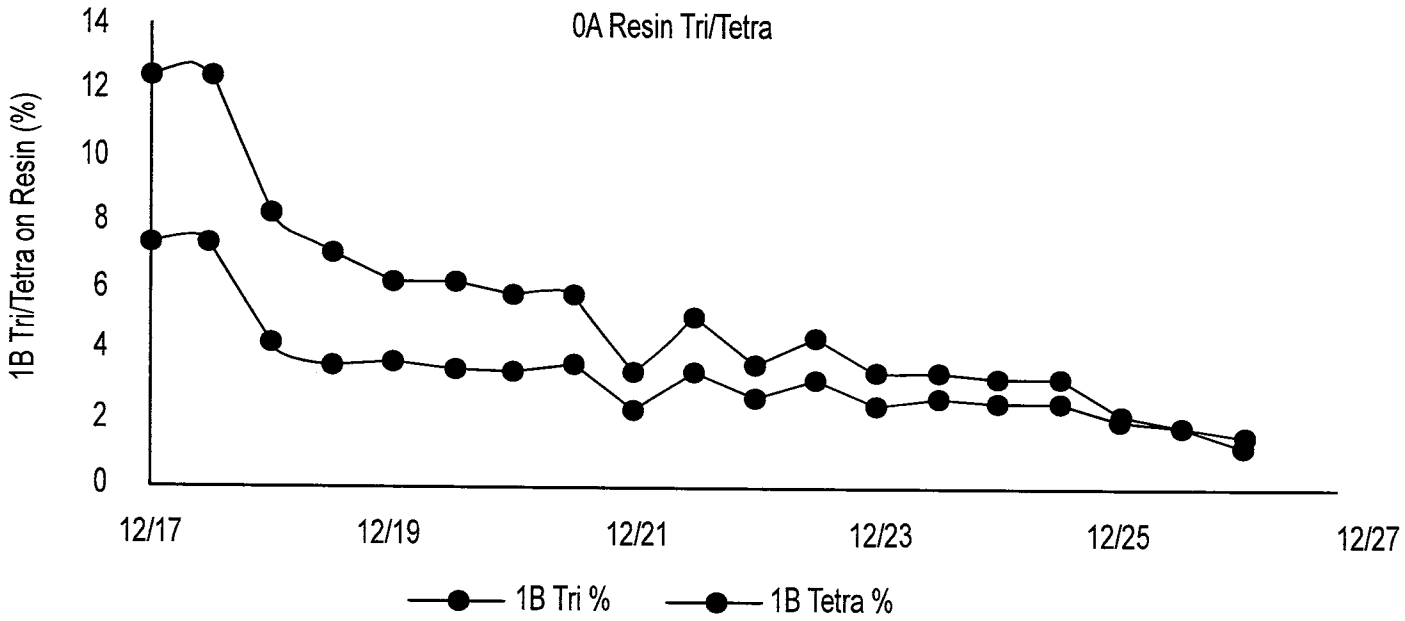
FIG. 7 tri/tetrathionates on resin (%) (vertical axis) against date (horizontal axis) for an experiment using 0A resin.
Figure 8:
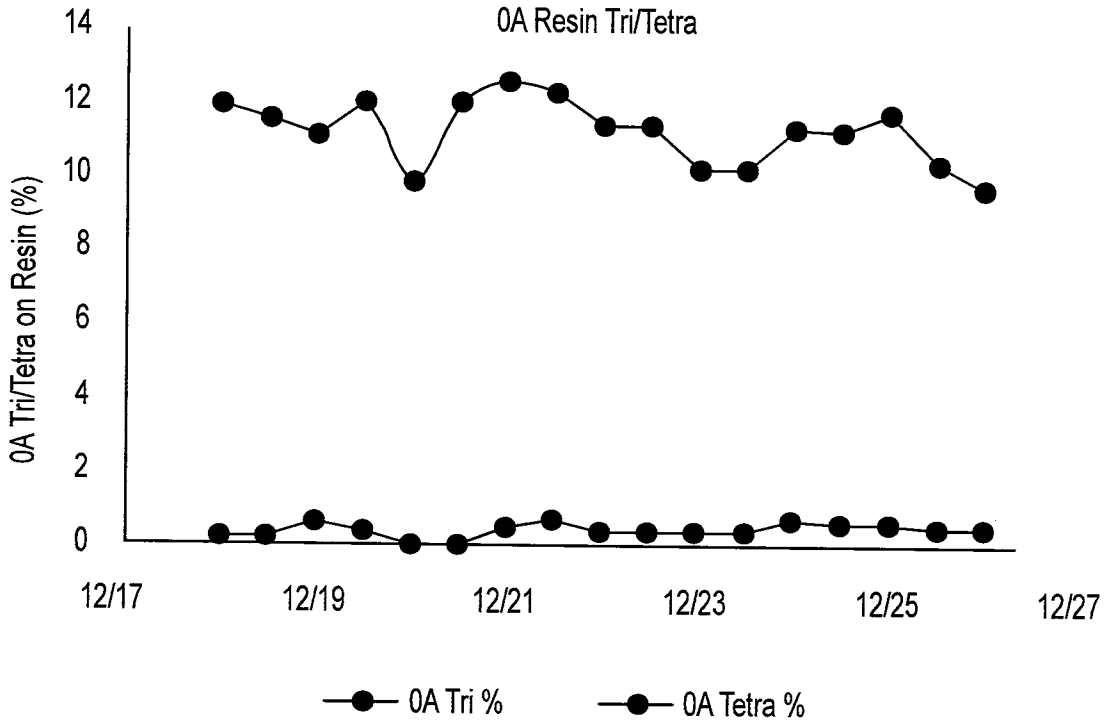
FIG. 8 tri/tetrathionates on resin (%) (vertical axis) against date (horizontal axis) for an experiment using 0A resin.

Surprisingly, polythionate (e.g., trithionates and tetrathionates) remained relatively stable during the duration of the tests as seen in FIGS. 6-8. Polythionate concentrates on resin and in solution remained largely unchanged which contrasts past data where polythionate generation was uncontrollable once a tank was taken offline. However, it is not certain whether the lack of solubilized copper contributed to the stability of polythionates. It is surmised that the low polythionate concentrations contributed to low solution gold losses.

There were additional interesting observations from the batch tests. The first is that there was ~7% recovery difference between the 0A and 1B acid leach test where the only difference in operating parameter was that permeate was used for 0A dilution while thiosulfate discharge and regenerated thiosulfate was used for 1B dilution. This suggests that thiosulfate discharge and/or regenerated thiosulfate may have an adverse effect on recovery.

Secondly, the batch leach test for 0A acid was tested at 400 ppm thiosulfate. Small amounts of thiosulfate discharge and/or regenerated thiosulfate was inadvertently introduced to 0A. Calcium thiosulfate was not added to 0A due to plugged lines. With a recovery of 67.4% achieved, this indicates low thiosulfate concentrations still allow for sufficient leaching. Additionally, polythionate stability remained largely unaffected at this lower concentration.

Example 2

An alternative method for generating additional trithionate is to make use of some of the thiosulfate in the optional copper pre-elution feed. By adding peroxide to this stream, a larger volume (for instance 5BV) of lower concentration trithionate can be generated. This is advantageous, since the heat of reaction is taken up by the large solution volume, and, hence, an additional cooling system or cooling capacity is not necessary.

Figure 9:
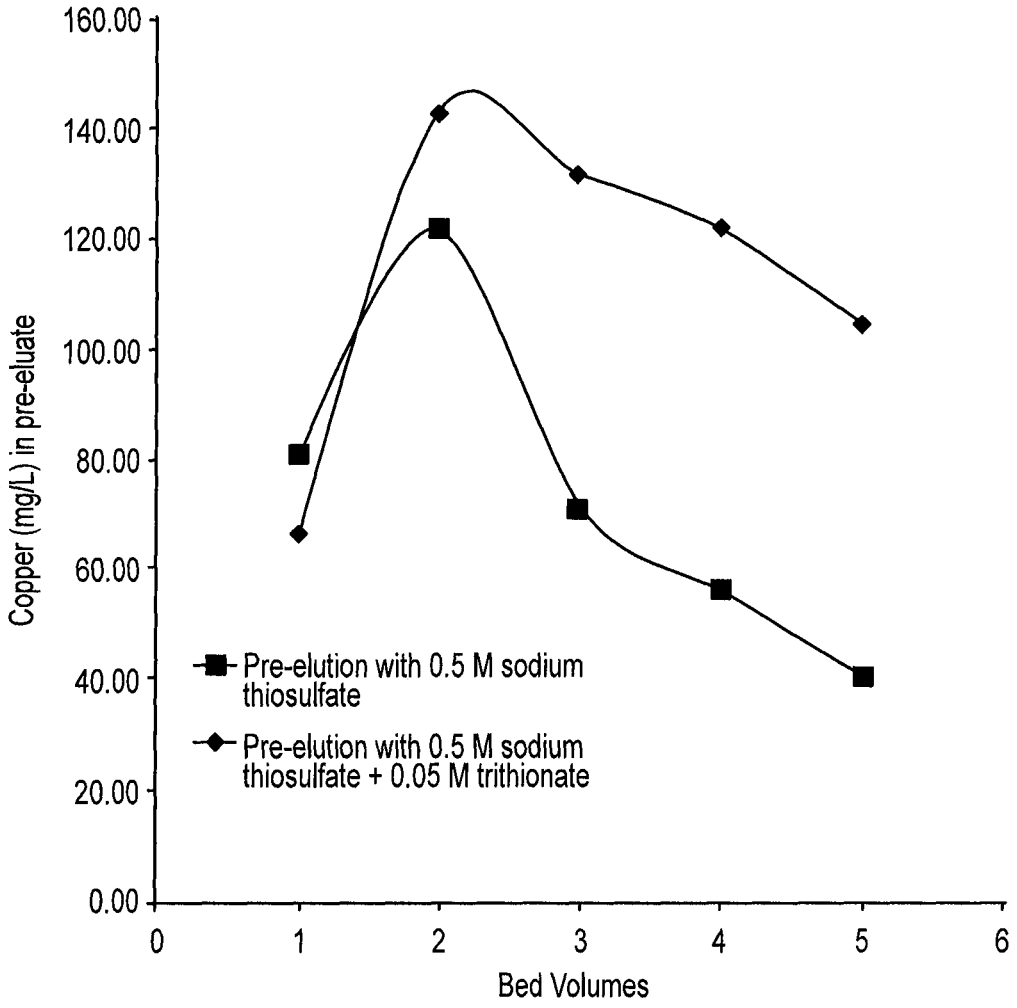
FIG. 9 is a copper pre-elution curve demonstrating pre-elution of copper from an anion exchange resin by 0.5 M sodium thiosulfate with and without hydrogen peroxide addition.
Figure 10:
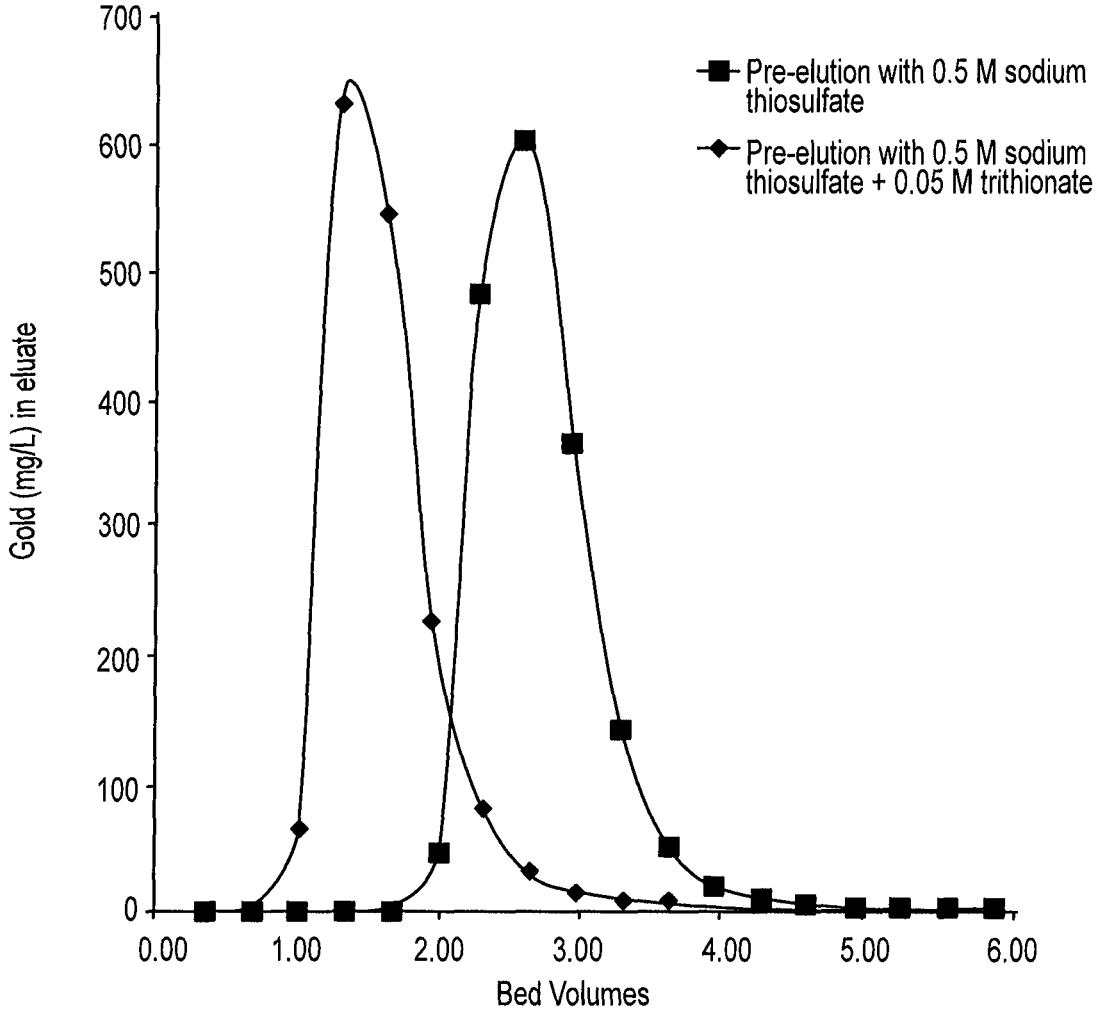
FIG. 10 is an elution curve demonstrating elution of gold from an anion exchange resin by 0.2M trithionate in admixture with 0.2 M sodium sulfite following copper pre-elution by 0.5 M sodium thiosulfate with and without hydrogen peroxide addition.

FIG. 9 shows the profile for copper pre-elution for a 0.5 M sodium thiosulfate solution, compared to a solution for which sodium thiosulfate and peroxide were mixed to give a composition of 0.5 M sodium thiosulfate+0.05 M sodium trithionate, as per reaction 2. The presence of trithionate in the thiosulfate pre-eluant results in a higher quantity of copper being stripped from the resin during 30 copper pre-elution. This is beneficial to the gold elution process, as increasing the stripping of copper during pre-elution results in less copper in the final gold product. Another significant advantage of adding peroxide to the copper pre-elution stream is an improvement in the gold elution performance in terms of required breakthrough volume. FIG. 10 shows the gold elution profiles obtained for a mixture of 0.2 M trithionate+0.2 M sulfite. The resin which had been pre-eluted in the presence of the trithionate undergoes elution earlier than the other sample resin, with the gold elution peak being after 1.3 bed volumes of solution, compared to 2.6 bed volumes, respectively. In addition, the peak gold concentration is higher for the resin which had been pre-eluted in the presence of trithionate. This is also advantageous, as more concentrated gold electrowinning product may be generated. For the data in FIGS. 9 and 10, the resin had the same loading of all species, including copper and gold.

Without wishing to be bound by theory, it appears that the role of peroxide addition to the copper pre-elution is to generate a low concentration of trithionate, which does not strip the gold during the copper pre-elution stage, but conditions the resin by adsorbing trithionate prior to the gold elution stage. This results in a significantly better performance during the elution step. Preferably, the addition of peroxide to the copper pre-elution should be between about 0.1 and 2.0 moles of hydrogen peroxide per L of resin to be eluted to produce a concentration of trithionate in pre-elution ranging from about 0.025 to about 0.5 moles/L resin. For the data in FIG. 9, 5 BV of solution containing 0.05 M trithionate was utilized, for which the peroxide addition was 1 mole per L of resin, and the quantity of trithionate was 0.25 moles per L of resin. Tests were also conducted with 5 BV of copper pre-eluant containing 0.025 M trithionate (i.e. 0.5 moles of peroxide per L of resin), and good results were also obtained. It should be apparent that, when the loaded resin contains a higher concentration of polythionates, less conditioning, i.e., 0.1 moles of peroxide per L of resin, may be preferred. However if the loaded resin contains a very low loading of polythionates, more conditioning may be required. Therefore, this is a robust process that can treat a wide range of resin feeds.

Various sources of thiosulfate can be adopted for pre-elution, and since the product is recycled to leach, the thiosulfate salt needs to be compatible with the leach system. When adopting an ammonium thiosulfate leach, the preferred reagent for elution would be ammonium thiosulfate. However, for non-ammonium based leach systems, alternative reagents such as calcium thiosulfate can be adopted. However, as discussed above, a calcium removal step may be required. For instance, the system described in Example 2 can also be adopted here, whereby the reverse osmosis concentrate is combined with calcium thiosulfate, followed by gypsum removal. Ideally, the peroxide is added prior to gypsum removal, since reaction 2 generates sulfate.

A number of variations and modifications of the disclosure can be used. It would be possible to provide for some features of the disclosure without providing others.

The present disclosure, in various aspects, embodiments, and configurations, includes components, methods, processes, systems and/or apparatus substantially as depicted and described herein, including various aspects, embodiments, configurations, subcombinations, and subsets thereof. Those of skill in the art will understand how to make and use the various aspects, aspects, embodiments, and configurations, after understanding the present disclosure. The present disclosure, in various aspects, embodiments, and configurations, includes providing devices and processes in the absence of items not depicted and/or described herein or in various aspects, embodiments, and configurations hereof, including in the absence of such items as may have been used in previous devices or processes, e.g., for improving performance, achieving ease and or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more, aspects, embodiments, and configurations for the purpose of streamlining the disclosure. The features of the aspects, embodiments, and configurations of the disclosure may be combined in alternate aspects, embodiments, and configurations other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed aspects, embodiments, and configurations. Thus, the following claims are hereby incorporated into this Detailed Description, with each claim standing on its own as a separate preferred embodiment of the disclosure.

Moreover, though the description of the disclosure has included description of one or more aspects, embodiments, or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method, comprising:

leaching a precious metal-containing material with a thiosulfate-containing leach solution while in contact with a barren resin comprising a quaternary ammonium compound to form a precious metal-containing solution and tails, wherein the thiosulfate-containing leach solution is substantially free of amines;

loading a precious metal dissolved in the precious metal-containing solution onto a barren resin comprising a quaternary ammonium compound to form a precious metal-loaded resin and a precious metal barren solution, the thiosulfate-containing leach solution comprising amines and wherein a concentration of amines in the thiosulfate-containing leach solution is maintained sat a concentration of no more than about 100 ppm;

contacting the precious metal-loaded resin with a precious metal eluant comprising trithionate and a sulfite ion to form a precious metal-rich eluant and the barren resin;

recovering the precious metal from the precious metal-rich eluant;

separating a liquid fraction from a solid fraction of the tails; and filtering the liquid fraction to form a permeate and a concentrate comprising an amine, wherein the leaching is substantially free of the concentrate.

2. The method of claim 1, wherein a concentration of trithionate in the precious metal-containing solution is no more than about 5,000 ppm, wherein a trithionate source is trithionate loaded onto the barren resin recycled to the loading, wherein a concentration of the sulfite ion in the precious metal eluant is at least about 0.01 M, wherein a pH of the precious metal eluant is maintained within a range of from about pH 4.5 to about pH 14, and wherein a concentration of trithionate in the precious metal eluant is at least about 0.01 M.

3. The method of claim 1, wherein the thiosulfate-containing leach solution is substantially free of thiols, wherein the thiosulfate-containing leach solution comprises no more than about 180 ppb amines and thiols, collectively and wherein the thiosulfate-containing leach solution is substantially free of liquid and/or dissolved solids from a reclaim tank storing previously leached precious metal-containing material.

4. The method of claim 1, wherein thiosulfate-containing leach solution comprises thiols, wherein a concentration of thiols in the thiosulfate-containing leach solution is maintained at a concentration of no more than about 100 ppm, wherein the thiosulfate-containing leach solution comprises non-ammonium sources of thiosulfate, and wherein at least a portion of the thiosulfate-containing leach solution is recycled to the leaching.

5. The method of claim 1, wherein the precious metal comprises gold, and further comprising: recycling the barren resin to the loading in the absence of barren resin regeneration, wherein the barren resin recycled to the leaching is substantially free of sorbed sulfide ion to inhibit precipitation of gold sulfides from the precious metal-containing solution, and wherein the recycled barren resin in the loading comprises at least about 0.1 M of tetrathionate.

6. The method of claim 1, wherein the precious metal comprises gold, wherein the precious metal-containing solution further comprises copper, wherein copper is loaded with the precious metal onto the precious metal-loaded resin, and wherein at least about 5 mol % of Group 11 (IUPAC) metals loaded onto the precious metal-loaded resin comprises copper and more than about 50 mol % of the Group 11 (IUPAC) metals loaded onto the precious metal-loaded resin comprise gold and wherein the recovering comprises electrowinning gold from the precious metal-rich eluant to form a barren electrowinning solution comprising trithionate and recovered gold and further comprising:

recycling the barren electrowinning solution to the contacting.

7. The method of claim 6, wherein in the contacting of the precious metal-loaded resin with the precious metal eluant the precious metal-loaded resin is free of copper elution.

8. The method of claim 1, further comprising: recycling the barren resin to the loading without being regenerated, wherein a concentration of one or more of tetrathionates, trithionates, sulfur-oxygen anions, and combinations thereof is maintained within about 50% of a concentration level of the one or more of tetrathionates, trithionates, sulfur-oxygen anions, and combinations thereof in the precious metal-containing solution before contact with the recycled barren resin.

9. The method of claim 8, further comprising maintaining a concentration of one or more of tetrathionates, trithionates, sulfur-oxygen anions, and combinations thereof in the precious metal-containing solution within about 5% of a concentration level of the one or more of tetrathionates, trithionates, sulfur-oxygen anions, and combinations thereof in the precious metal-containing solution before contact with the recycled barren resin and wherein, for a selected volume of barren resin, a number of loading and elution cycles within a 24-hour period is from about 1 to about 5.

10. The method of claim 1, wherein a concentration of amines in the precious metal barren solution recycled to the leaching is maintained at a concentration of no more than about 20 ppm and wherein in the leaching the thiosulfate-containing leach solution is free of added copper and comprises no more than about 10,000 ppm thiosulfate.

11. A method, comprising:

(a) contacting a precious metal-containing thiosulfate leach solution with a barren ion exchange resin to form a precious metal-loaded resin and a precious metal barren thiosulfate-containing leach solution, wherein a concentration of amines in the precious metal-containing thiosulfate leach solution is no more than about 100 ppb;

(b) contacting the precious metal-loaded resin with a precious metal-barren eluant comprising trithionate and a sulfite ion to form a precious metal-rich eluant and a barren resin wherein the precious metal-loaded resin comprises an ammonium compound and wherein the ammonium compound releases amines into the precious metal barren thiosulfate-containing leach solution;

(c) recovering a precious metal from the precious metal-rich eluant to form the precious metal-barren eluant for recycle to the contacting (b);

(d) separating a liquid fraction from a solid fraction of the precious metal barren thiosulfate leach solution;

(e) recycling a portion of the liquid fraction to the contacting (a); and (f) inhibiting recycle of any portion of the solid fraction to the contacting (a), wherein the recycled portion of the liquid fraction comprises no more than about 10 vol. % of a recycled solid fraction.

12. The method of claim 11, wherein a concentration of trithionate in the precious metal-containing thiosulfate leach solution is no more than about 5,000 ppm, wherein a trithionate source is trithionate loaded onto the barren resin recycled to the contacting (a), wherein the precious metal comprises gold, wherein a sulfite ion concentration in the precious metal-barren eluant is at least about 0.01 M, wherein a pH of the precious metal-barren eluant is maintained within a range of from about pH 4.5 to about pH 14, and wherein a trithionate concentration in the precious metal-barren eluant is at least about 0.01 M and further comprising filtering the liquid fraction to form a permeate and a concentrate, wherein the contacting (a) is substantially free of the concentrate.

13. The method of claim 11, wherein the precious metal-containing thiosulfate leach solution is free of liquid or solid in tails generated in the contacting (a), wherein the precious metal-containing thiosulfate leach solution comprises no more than about 100 ppm thiols.

14. The method of claim 13, wherein the method is free of gypsum precipitation from tails.

15. The method of claim 11, wherein the precious metal comprises gold, and further comprising recycling the barren resin to the contacting (a), wherein the barren resin recycled to the contacting (a) is free of a sorbed sulfide, bisulfide, and polysulfide to inhibit precipitation of gold sulfides from the precious metal-containing thiosulfate leach solution and further comprising: recycling the barren resin to the contacting (a) in the absence of barren resin regeneration, wherein the recycled barren resin in the contacting (a) comprises at least about 0.1 M of tetrathionate.

16. The method of claim 11, wherein a concentration of thiosulfate in the precious metal-containing thiosulfate leach solution is no more than about 10,000 ppm, wherein the precious metal comprises gold, wherein the precious metal-containing thiosulfate leach solution is derived from thiosulfate leaching of a precious metal-containing feed material, wherein the precious metal-containing feed material comprises at least about 0.5 wt. % preg-robbing carbonaceous materials and wherein the precious metal-containing feed material comprises no more than about 0.35 oz/ton gold and further comprising maintaining a concentration of one or more of tetrathionates, trithionates, sulfur-oxygen anions, and combinations thereof in the precious metal-containing thiosulfate leach solution within about 5% of a concentration level of the one or more of tetrathionates, trithionates, sulfur-oxygen anions, and combinations thereof in the precious metal-containing thiosulfate leach solution before contact with the recycled barren resin, wherein, for a selected volume of barren resin, a number of loading and elution cycles within a 24-hour period is from about 1 to about 5.

17. The method of claim 11, wherein the precious metal comprises gold, wherein the precious metal-containing thiosulfate leach solution further comprises copper, wherein copper is loaded with the precious metal onto the precious metal-loaded resin, wherein at least about 5 mol % of Group 11 (IUPAC) metals loaded onto the precious metal-loaded resin comprises copper and more than about 50 mol % of the Group 11 (IUPAC) metals loaded onto the precious metal-loaded resin comprise gold, and wherein the recovering comprises electrowinning gold from the precious metal-rich eluant to form a barren electrowinning solution comprising trithionate and recovered gold and further comprising:

recycling the barren electrowinning solution to the contacting (b).

18. A method, comprising:

(a) contacting a precious metal-containing thiosulfate leach solution with a regenerated barren ion exchange resin to form a precious metal-loaded resin and a precious metal barren thiosulfate leach solution, wherein a concentration of sulfide ions in the precious metal-containing thiosulfate leach solution from the regenerated barren ion exchange resin is no more than about 100 ppm to inhibit precipitation of gold sulfides from the precious metal-containing thiosulfate leach solution;

(b) contacting the precious metal-loaded resin with a precious metal-barren eluant comprising trithionate and a sulfite ion to form a precious metal-rich eluant and a barren resin; and (c) recovering a precious metal from the precious metal-rich eluant to form the precious metal-barren eluant for recycle to the contacting (b).

19. The method of claim 18, wherein the concentration of sulfide ions in the precious metal-containing thiosulfate leach solution from the regenerated barren ion exchange resin is no more than about 50 ppm.

20. The method of claim 18, wherein the concentration of sulfide ions in the precious metal-containing thiosulfate leach solution from the regenerated barren ion exchange resin is no more than about 1 ppm to inhibit precipitation of gold sulfides from the precious metal-containing thiosulfate leach solution, wherein a concentration of thiosulfate in the precious metal-containing thiosulfate leach solution is no more than about 10,000 ppm, wherein the trithionate source is trithionate loaded onto the barren resin recycled to the loading, wherein the precious metal comprises gold, wherein the precious metal-containing thiosulfate leach solution is derived from thiosulfate leaching of a precious metal-containing feed material, wherein the precious metal-containing feed material comprises at least about 0.5 wt. % preg-robbing carbonaceous materials and wherein the precious metal-containing feed material comprises no more than about 0.35 oz/ton gold and further comprising:

separating a liquid fraction from a solid fraction of a precious metal barren thiosulfate leach solution; and filtering the liquid fraction to form a permeate and a concentrate, wherein the contacting (a) is substantially free of the concentrate.

21. The method of claim 18, wherein the precious metal-containing thiosulfate leach solution is substantially free of amines and thiols, wherein the precious metal-loaded resin in the contacting (b) is free of prior elution of copper collected on a surface of the precious metal-loaded resin and further comprising maintaining a concentration of one or more of tetrathionates, trithionates, sulfur-oxygen anions, and combinations thereof in the precious metal-containing thiosulfate leach solution within about 5% of a concentration level of the one or more of tetrathionates, trithionates, sulfur-oxygen anions, and combinations thereof in the precious metal-containing thiosulfate leach solution before contact with the regenerated barren ion exchange resin.

22. The method of claim 18, wherein the precious metal comprises gold, wherein the precious metal-loaded resin in the contacting (b), prior to contact with the precious metal-barren eluant, is contacted with a copper eluant solution and wherein the recovering comprises electrowinning gold from the precious metal-rich eluant to form a barren electrowinning solution comprising trithionate and recovered gold and further comprising:

recycling the barren electrowinning solution to the contacting (b).

23. A method, comprising:

leaching a precious metal-containing material with a thiosulfate-containing leach solution to form a precious metal-containing solution, wherein the thiosulfate-containing leach solution is substantially free of liquid and/or dissolved solids from a tailings storage facility storing previously leached precious metal-containing material;

loading a precious metal dissolved in the precious metal-containing solution onto a recycled barren resin to form a precious metal-loaded resin and a precious metal barren solution, wherein the precious metal-containing solution further comprises copper and wherein copper is loaded with the precious metal onto the precious metal-loaded resin;

contacting, in the absence of prior removal of the copper loaded onto the precious metal-loaded resin, the precious metal-loaded resin with a precious metal eluant comprising trithionate and a sulfite ion to form a precious metal-rich eluant and the recycled barren resin, wherein at least about 5 mol % of Group 11 (IUPAC) metals loaded onto the precious metal-loaded resin immediately before the contacting comprises copper and more than about 50 mol % of the Group 11 (IUPAC) metals loaded onto the precious metal-loaded resin comprise gold; and recovering the precious metal from the precious metal-rich eluant.

24. The method of claim 23, wherein the leaching is performed while the thiosulfate-containing leach solution is in contact with the recycled barren resin, wherein a concentration of trithionate in the precious metal-containing solution is no more than about 2,500 ppm, wherein a trithionate source is trithionate loaded onto the recycled barren resin recycled to the loading, and wherein a concentration of trithionate in the precious metal eluant is at least about 50,000 ppm, wherein the recycled barren resin is recycled to the leaching free of contact with a sulfide, bisulfide, and polysulfide, wherein a number of elution cycles within a 24-hour period for any recycled barren resin ranges from about 1 to about 5 to inhibit release of deleterious chemical species into the thiosulfate-containing leach solution, wherein the recycled barren resin is recycled to the loading and wherein the recycled barren resin is recycled free of contact with a sulfide, bisulfide, and polysulfide and further comprising:

maintaining a concentration of a deleterious chemical species to precious metal recovery, the deleterious chemical species comprising one or more of tetrathionate, trithionate, sulfur-oxygen anions, and lead, copper, and zinc thiosulfate complexes in the thiosulfate-containing leach solution within about 5% of a concentration level of the one or more of tetrathionates, trithionates, sulfur-oxygen anions, and combinations thereof in the thiosulfate-containing leach solution before contact with the recycled barren resin.

25. The method of claim 23, wherein the precious metal dissolved in the precious metal-containing solution is loaded onto the recycled barren resin comprising at least about 0.1 mole/L of trithionate to form the precious metal-loaded resin and a precious metal barren solution, wherein a concentration of trithionate in the precious metal-containing solution is no more than about 5,000 ppm, wherein the trithionate is desorbed from the recycled barren resin during loading, and wherein a concentration of trithionate in the precious metal eluant is at least about 25,000 ppm.

26. A method, comprising:

leaching a precious metal-containing material with a thiosulfate-containing leach solution to form a precious metal-containing solution;

loading a precious metal dissolved in the precious metal-containing solution onto a recycled barren resin to form a precious metal-loaded resin and a precious metal barren solution, the recycled barren resin comprising trithionate;

contacting the precious metal-loaded resin with a precious metal eluant comprising trithionate and a sulfite ion to form a precious metal-rich eluant and the recycled barren resin;

recovering the precious metal from the precious metal-rich eluant, wherein a concentration of trithionate in the precious metal-containing solution is no more than about 5,000 ppm, wherein a trithionate source is trithionate loaded onto the recycled barren resin recycled to the loading, and wherein a concentration of trithionate in the precious metal eluant is at least about 25,000 ppm; and recycling the recycled barren resin to the loading without being regenerated to remove trithionate from the recycled barren resin, wherein a concentration in the precious metal-containing solution of a deleterious chemical species to precious metal recovery, the deleterious chemical species comprising one or more of tetrathionates, trithionates, sulfur-oxygen anions, and combinations thereof after contact of the precious metal-containing solution with the recycled barren resin is maintained within about 50% of a concentration in the precious metal-containing solution of the deleterious chemical species, and combinations thereof before contact of the precious metal-containing solution with the recycled barren resin.

27. The method of claim 26, wherein the leaching is performed while the thiosulfate-containing leach solution is in contact with the recycled barren resin, wherein the recycled barren resin comprises at least about 0.1 mole/L of trithionate, wherein the concentration of trithionate in the precious metal-containing solution is no more than about 2,500 ppm, wherein the trithionate source is trithionate loaded onto the recycled barren resin, and wherein a concentration of trithionate in the precious metal eluant is at least about 50,000 ppm and further comprising:

maintaining a concentration of the deleterious chemical species in the thiosulfate-containing leach solution within about 5% of a concentration level of the one or more of tetrathionates, trithionates, sulfur-oxygen anions, and combinations thereof in the thiosulfate-containing leach solution before contact with the recycled barren resin.

28. A method, comprising:

(a) contacting a precious metal-containing thiosulfate leach solution with a barren ion exchange resin to form a precious metal-loaded resin and a precious metal barren thiosulfate leach solution, wherein a concentration of sulfide ions in the precious metal-containing thiosulfate leach solution from the barren ion exchange resin is no more than about 100 ppm to inhibit precipitation of gold sulfides from the precious metal-containing thiosulfate leach solution, wherein the barren ion exchange resin comprises trithionate sorbed on a surface of the barren ion exchange resin, and wherein a trithionate concentration in the precious metal-containing thiosulfate leach solution is no more than about 5,000 ppm;

(b) contacting the precious metal-loaded resin with a precious metal-barren eluant comprising trithionate and a sulfite ion to form a precious metal-rich eluant and a barren resin, wherein a trithionate concentration in the precious metal-barren eluant is at least about 25,000 ppm; and (c) recovering a precious metal from the precious metal-rich eluant to form the precious metal-barren eluant for recycle to the contacting (b).

29. The method of claim 28, wherein the barren resin comprises at least about 0.1 mole/L of trithionate sorbed onto a resin surface, wherein a concentration of trithionate in the precious metal-containing thiosulfate leach solution is no more than about 2,500 ppm, wherein a trithionate source is trithionate loaded onto the barren resin recycled to the contacting (a), and wherein a concentration of trithionate in the precious metal eluant is at least about 50,000 ppm, wherein the barren resin is recycled to the contacting (a) free of contact with a sulfide, bisulfide, and polysulfide, and wherein a concentration of trithionate in the precious metal-containing thiosulfate leach solution is no more than about 5,000 ppm.

* * * * *